US007344308B2

(12) United States Patent
Meyer et al.

(10) Patent No.: US 7,344,308 B2
(45) Date of Patent: Mar. 18, 2008

(54) TOWEL SLEEVE

(75) Inventors: Dean E. Meyer, Oakbrook, IL (US); Terrance J. McNamara, Deland, FL (US)

(73) Assignee: Concept2Reality, LLC, Oakbrook, IL (US)

( * ) Notice: Subject to any disclaimer, the term of this patent is extended or adjusted under 35 U.S.C. 154(b) by 261 days.

(21) Appl. No.: 11/079,665

(22) Filed: Mar. 14, 2005

(65) Prior Publication Data

US 2005/0205456 A1 Sep. 22, 2005

Related U.S. Application Data

(60) Provisional application No. 60/554,459, filed on Mar. 19, 2004.

(51) Int. Cl.
*B65D 33/00* (2006.01)

(52) U.S. Cl. ..... 383/41; 383/61.4; 383/72; 383/75

(58) Field of Classification Search ..... 383/41, 383/72, 74–75, 22–24, 61.4, 2
See application file for complete search history.

(56) References Cited

U.S. PATENT DOCUMENTS 2,080,252 A * 5/1937 Cook et al. ..... 383/90
2,497,325 A * 2/1950 Scherba ..... 382/38
4,200,133 A * 4/1980 Whitlow ..... 150/159
4,384,604 A * 5/1983 DeLaura et al. ..... 206/423
4,416,404 A * 11/1983 Daniels ..... 224/676
4,688,674 A * 8/1987 Stirtz ..... 206/388
4,939,778 A * 7/1990 Tomberlin ..... 379/438
5,359,810 A * 11/1994 Aul ..... 47/84
5,419,477 A 5/1995 Verge
5,490,594 A * 2/1996 Rupe ..... 206/315.4
5,590,775 A * 1/1997 Moore ..... 206/423
5,622,294 A * 4/1997 Evans ..... 224/184
5,692,836 A * 12/1997 Mitchell ..... 383/40
5,722,125 A * 3/1998 Vasilopoulos ..... 24/301
5,898,968 A * 5/1999 Beattie ..... 15/210.1
5,927,489 A 7/1999 Carswell
6,085,695 A * 7/2000 Miller et al. ..... 119/795
7,237,703 B1 * 7/2007 Nathan et al. ..... 224/148.5

* cited by examiner

*Primary Examiner*—Nathan J. Newhouse
*Assistant Examiner*—Jack Morgan

(57) ABSTRACT

A protective sleeve or jacket for a golf towel or the like. The sleeve comprises an elongated waterproof sheath defining a hollow interior adapted to receive and house the towel. The sleeve has opposed ends or collars adapted to be independently opened to allow access to the opposed ends of the towel for drying and cleaning purposes such as, for example, drying or cleaning a golf club, a golf ball or the golfer's hands.

5 Claims, 5 Drawing Sheets

TOWEL SLEEVE

RELATED APPLICATION

This application is related to and claims the benefit of U.S. Provisional Application No. 60/554,459 filed on Mar. 19, 2004, the contents of which are expressly incorporated herein by reference.

FIELD OF THE INVENTION

This invention relates to a protective sleeve or jacket for towels.

BACKGROUND OF THE INVENTION

Various sleeves or jackets for protecting and keeping towels dry such as, for example, towels used by golfers for drying or cleaning their clubs, have been developed and used over the years. Two such towel sleeves are described in U.S. Pat. Nos. 5,419,477 and 5,927,489. These sleeves are characterized in that they incorporate a single opening at the bottom of the sleeve through which the towel may be accessed. There however remains a need for a protective towel sleeve with multiple openings to allow for the quick, easy and efficient access to both ends of the towel. The sleeve of the present invention meets these needs.

SUMMARY OF THE INVENTION

The present invention is directed to a protective towel sleeve comprising an elongated protective sheath which includes an outer surface and an inner surface defining a hollow interior adapted to receive an elongate towel therewithin. The sheath defines a generally centrally located neck and unitary elongate sleeve arms extending outwardly from opposed ends of the neck and terminating in collars which can be loosened into an open configuration to allow access to opposed ends of the towel housed therein.

A drawstring member or elastic band may be associated with the neck and is adapted to tighten and hold the towel in the sleeve. Drawstring members may also be associated with the respective collars to allow the collars to be independently loosened open or cinched closed.

In one embodiment, the sleeve incorporates a pad which is suitably attached to the outer surface of the sheath and defines a non-slip surface which allows the sleeve to be supported in an over-the-shoulder relationship without slipping.

In another embodiment, the sleeve has a clip associated therewith and adapted to allow the sleeve to be clipped to the outer surface of an article such as, for example, the side of a golf bag or the like article.

Other advantages and features of the present invention will be more apparent from the following detailed description of the preferred embodiments of the invention, the accompanying drawings, and the appended claims.

DETAILED DESCRIPTION OF THE PREFERRED EMBODIMENTS

Figure 1:
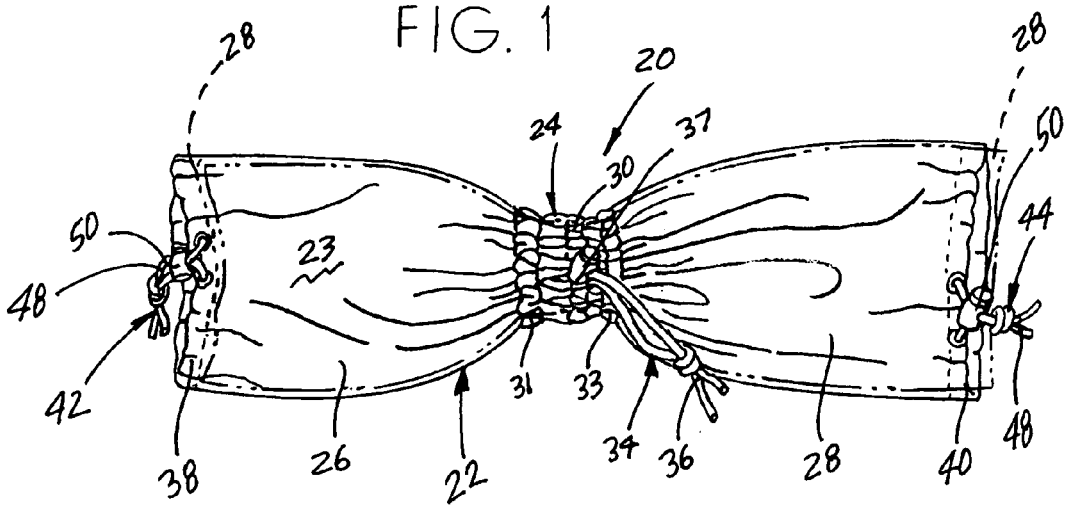
FIG. 1 is a side elevational view of a first embodiment of the towel sleeve of the present invention with both end collars in their loosened and open configuration and the center neck drawstring member in its cinched configuration.

The invention disclosed herein is, of course, susceptible of embodiment in many different forms. Shown in the drawings and described herein below in detail are preferred embodiments of the towel sleeve of the present invention. It is to be understood, however, that the present disclosure is an exemplification of the principles of the invention and does not limit the invention to the illustrated embodiments.

It is also understood that the Figures herein do not necessarily show or describe details of the towel sleeve that are known in the art and that will be recognized by those skilled in the art as such. The detailed descriptions of such elements are not necessary to an understanding of the invention. Accordingly, such elements are herein represented, shown, and described herein only to the degree necessary to aid in an understanding of the features of the towel sleeve of the present invention.

FIGS. 1-4 depict a first embodiment of a towel sleeve or jacket 20 in accordance with the present invention. Although the towel sleeve 20 is described herein as being adapted for use by golfers to dry their hands, their clubs or the golf ball, it is understood that the protective towel sleeve is likewise adapted for use in any sport or other environment or setting where it is desirable to have a clean and dry towel available for drying purposes.

The towel sleeve 20 comprises an elongated protective sheath 22 in the form of an open, generally cylindrically shaped bag or the like adapted to be opened at both ends which includes an outer surface 23 and an inner surface 25 defining a hollow interior adapted to receive and house an elongate towel or the like drying means 28 which is shown in phantom in FIGS. 1-4. Sheath 22 may be preferably made from any suitable waterproof material or fabric and includes a generally cylindrical centrally located neck portion 24 and a pair of opposed generally cylindrically shaped hollow sleeve arm portions 26 and 28 extending unitarily outwardly from the respective ends of the neck 24 when the neck 24 is cinched or tightened to hold and secure the towel 28 inside the sheath 22.

Figure 2:
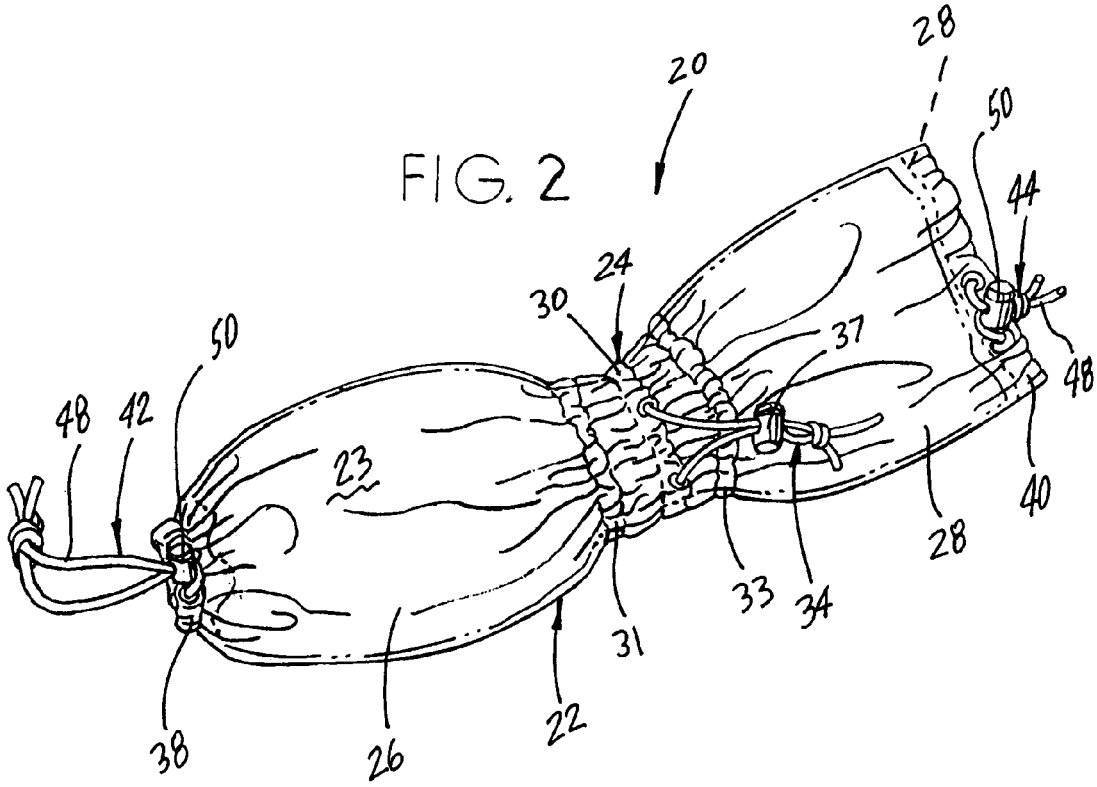
FIG. 2 is a side elevational view of the towel sleeve of FIG. 1 with one of the end collars in its cinched closed configuration and the center neck drawstring member in its loosened open configuration.
Figure 3:
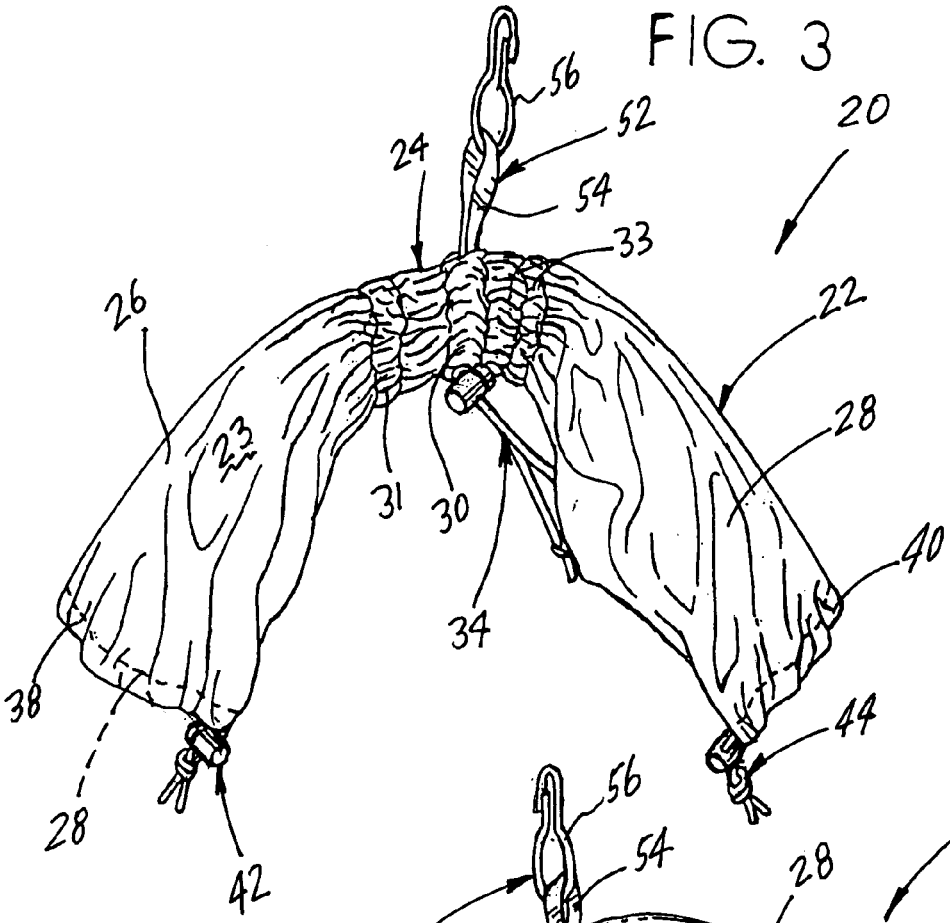
FIGS. 3 and 4 are perspective views of the towel sleeve of FIG. 1 in its folded, hanging orientation.
Figure 4:
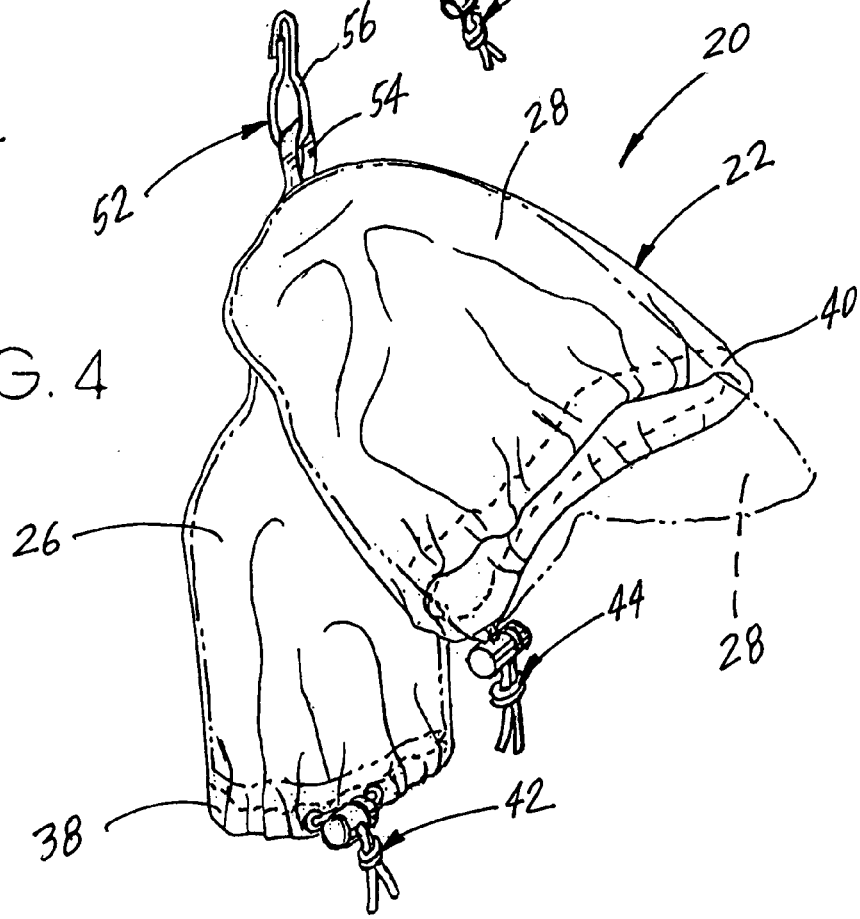

In the embodiment of FIGS. 1-4, the neck 24 defines a wide circumferentially extending elastic band 30 which is stitched or otherwise suitably sewn or incorporated into the material of sheath 22. Band 30 is positioned in a generally normal relationship to the sleeve longitudinal axis, is centrally located on the sleeve 20, and is adapted to squeeze and cinch the neck 24 of sheath 22. Neck 24 additionally defines second and third circumferentially extending elastic bands 31 and 33 on opposite sides of, spaced from, and parallel to, the central band 30. Elastic bands 31 and 33 are likewise stitched or otherwise suitably incorporated into the fabric of sheath 22. Neck 24 additionally incorporates a drawstring member 34 including a drawstring 36 and drawstring retaining clip 37 which is co-planar with the central band 30 and adapted to cooperate with the sheath 22 to allow the tightening or cinching of neck 24 when drawstring 36 is tightened. Drawstring 36 comprises an elongate elastic string or lace which extends through a circumferential passage defined in the material comprising sheath 22 and elastic band 30 and out through eyelets 39 (FIG. 2).

Sleeve arms 26 and 28 extending unitarily outwardly from opposite ends of the neck 24 terminate in peripheral end collars 38 and 40 defining access openings into the interior of sheath 22. The collars 38 and 40 incorporate respective drawstring members 42 and 44, each including a drawstring 48 and drawstring retaining clip 50 similar in structure to the drawstring member 34 and clip 37. Drawstring members 42 and 44 are adapted to independently allow the loosening, i.e., the opening, and the closing, i.e., cinching, of collars 38 and 40 of sleeve 20 as described below in more detail. Each of the drawstring members 42 and 44 comprises an elongate string or lace made of cloth or the like material which extends through a circumferential passage or opening which has been defined in the material of the sheath 22 and extending circumferentially along the edge of each of the collars 38 and 40 respectively.

In accordance with the present invention, towel 28 preferably has a length equal to or less than the length of the sleeve 20 and is adapted to be fed through either of the open collars 38 and 40 of sleeve 20 and advanced successively through one of the sleeve arms 26, the neck 24, and then through the other of the sleeve arms 28, so that towel 28 extends through the full length of the interior of the sleeve 20. Thereafter, the drawstring 36 of drawstring member 34 is tightened and cinched thereby squeezing and tightening the neck of sheath 22 around the towel 28 as shown in FIGS. 1-4. Clip 37 is then slid inwardly along drawstring 36 and is locked against the outer surface 24 of the sheath 22 to hold the drawstring 36 tight around the towel 28 thus preventing the towel 28 from sliding out of the sleeve 20 during use.

In accordance with the present invention, the ends or collars 38 and 40 of sleeve 20 may be loosened and opened independently to allow access to one or both ends of the towel 28 located with the interior thereof. For example, in the application wherein sleeve 20 is used by golfers, one of the collars 38 and 40 of sleeve 20 can be loosened and opened to allow access to one end of the towel for drying or cleaning off a club or ball while the other collar can be loosened and opened separately to allow access to the other end of the towel to allow a golfer to dry or clean his/her hands. After use, of course, drawstring members 42 and 44 can be tightened using respective clips 50 to cinch off and close both of the collars 38 and 40 to keep the towel 28 therein dry.

Although not shown in any of the drawings or described herein in any detail, it is understood that the drawstring members 42 and 44 on collars 38 and 40 respectively could be substituted with elastic bands or the like structure adapted to allow the ends of the sleeve to be opened or closed.

In accordance with the present invention, a dirty or wet towel may be replaced simply by loosening each of the respective drawstring members 34, 42 and 44 and subsequently removing the towel from the interior of the sheath 22.

Figure 10:
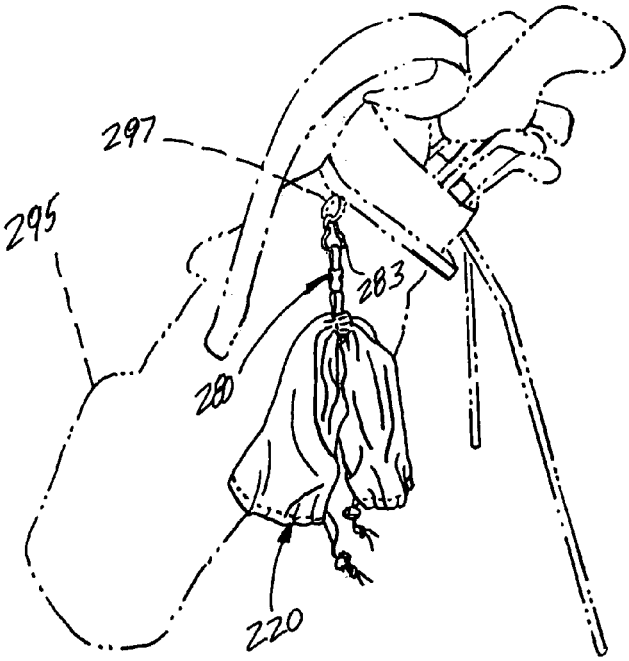
FIG. 10 is a perspective view of the towel sleeve of FIG. 7 hanging and clipped to the side of a golf bag.

Sleeve 20 is additionally adapted to include a clip member 52 (FIGS. 3 and 4) comprising a looped strap 54 which is stitched or otherwise suitably secured to the outer surface 23 of the sheath 22 and a separate clip in the form of a key ring 56 which is adapted to be clipped to the end of the strap 54 and then to any desired article such as, for example, the ring attached to the side of a golf bag as shown in FIG. 10.

Figure 5:
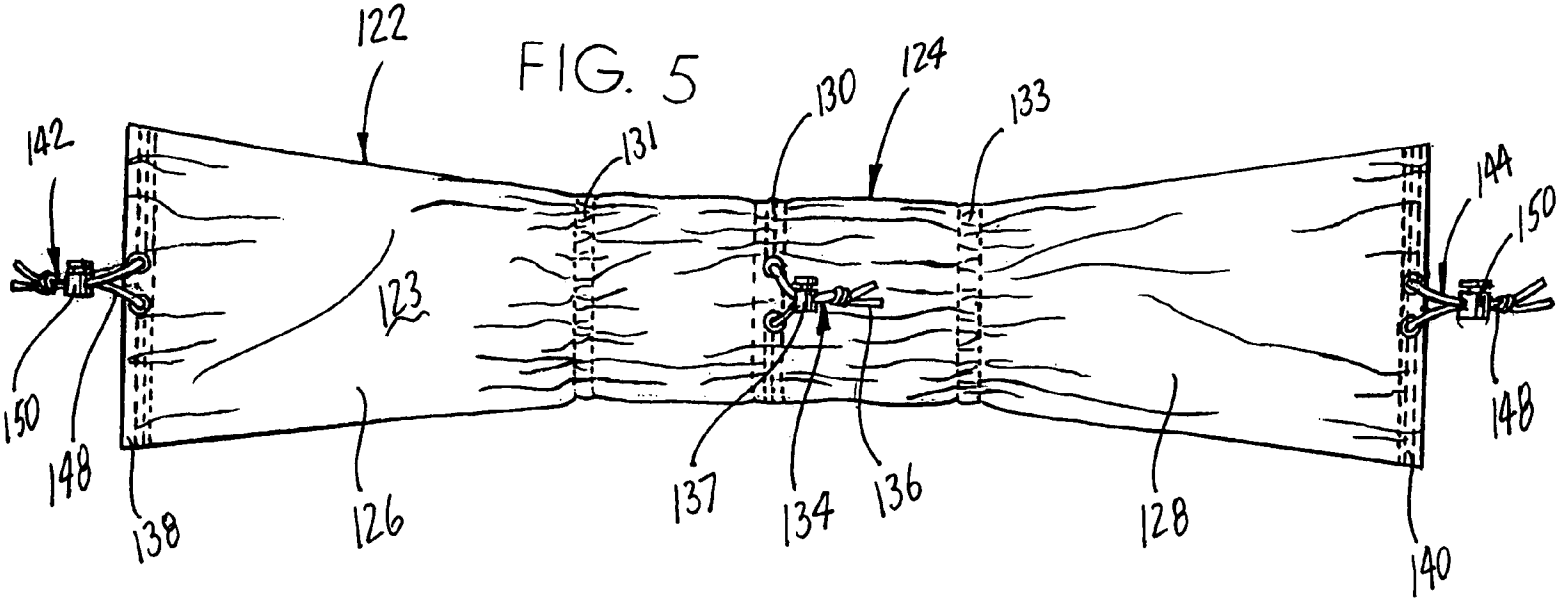
FIG. 5 is a top elevational view of another embodiment of the towel sleeve of the present invention.
Figure 6:
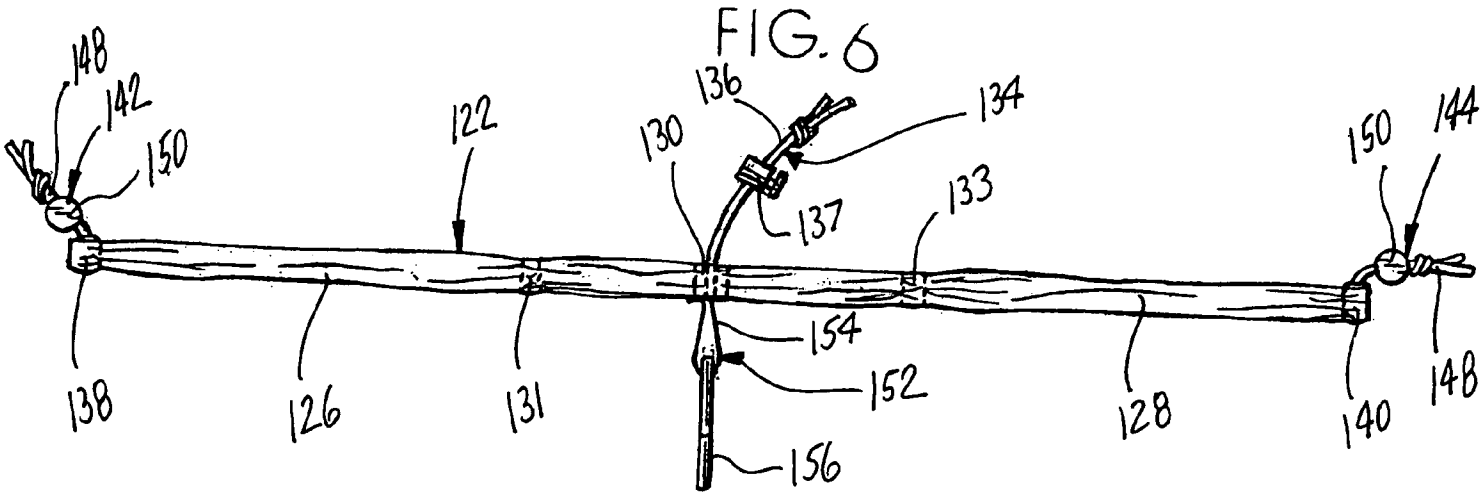
FIG. 6 is a side elevational view of the towel sleeve of FIG. 5.

FIGS. 5 and 6 depict another embodiment of the towel sleeve of the present invention, generally designated with the numeral 120, which is similar in structure and function to the towel sleeve embodiment 20 shown in FIGS. 1-4 except for the structure, configuration and shape of the sleeve arms thereof as described in more detail below.

Sleeve 120 comprises an elongate protective sheath 122 in the form of a bag with open opposite ends and including an outer surface 123 and an inner surface (not shown) defining a hollow interior adapted to receive and house a towel 28 in the same manner as described above with respect to sleeve 20. Sheath 122 is preferably made of the same type of waterproof material or fabric as sheath 22.

Sheath 122 of sleeve 120 is similar in structure to the sheath 22 of sleeve 20 in that sheath 122 includes an elongated and expanded central generally cylindrically shaped neck portion 124 which incorporates first, second and third circumferentially extending elastic bands 130, 131 and 133 similar in structure, configuration and placement to the bands 30, 31 and 33 respectively of sleeve 20. Neck 124 additionally incorporates a central drawstring member 134 comprising an elongate drawstring 136 and drawstring retaining clip 137 similar in structure, configuration, and placement to drawstring 36 and clip 37 of drawstring member 34 and is thus adapted to function in the same manner as drawstring member 34 to allow the tightening and cinching of the neck 124 of sheath 122 around the towel 28 as described earlier with respect to sleeve 20 and thus incorporated herein by reference.

As described earlier with respect to sleeve embodiment 120, elastic bands 131 and 133 are spaced from and parallel to the central drawstring member 134 and band 130 and are sewn, stitched or otherwise suitably secured into the material of sheath 122 in a manner known to those of ordinary skill in the art.

Sleeve 120 differs from the sleeve 20 in that sleeve 120 additionally comprises a pair of frustoconically shaped sleeve arms 126 and 128 extending unitarily divergingly and flaringly outwardly from the opposed ends of the neck 124 and, more particularly, from the respective elastic bands 131 and 133.

Sleeve arms 126 and 128 terminate in open end collars 138 and 140 similar in structure and function to the collars 38 and 40 of sleeve 20 and including drawstring members 142 and 144, each including a drawstring 148 and drawstring retaining clip 150, all similar in structure, orientation, placement and function to the drawstring 48 and clip 50 of drawstring members 42 and 44 of sleeve 20, the description of which is thus incorporated herein by reference.

Towel 28 is inserted and cinched within the interior of sheath 122 and sleeve 120 is opened and closed in the same manner as described above with respect to sleeve 20, the description of which is incorporated herein by reference.

In accordance with this embodiment of the present invention, the frustoconical and flaring configuration of respective sleeve arms 126 and 128 provides and creates larger diameter collar openings which, in turn, allow for easier access to and use of the ends of the towel 28 housed therein.

FIGS. 7-11 depict yet another towel sleeve embodiment 220 which is similar in structure and function to both of the towel sleeve embodiments 20 and 120 except that the sleeve 220 additionally incorporates a non-slip pad 270 and clip members 280 and 290 associated therewith as described in more detail below.

As with the sleeve embodiments 20 and 120, sleeve 220 comprises an elongate sheath 222 in the form of an open, generally cylindrically shaped bag or the like which is adapted to be opened at both ends and includes an outer surface 223 and an inner surface (not shown) defining a hollow interior adapted to receive and house towel 28 in the same manner as described earlier with respect to sleeves 20 and 120. Sheath 222 is preferably made from the same type of material as the sheaths 22 and 122 of sleeves 20 and 120 respectively.

Sheath 222 defines a central neck 224 which includes a circumferentially extending elastic band 230 which is stitched or otherwise suitably secured or sewn into the fabric comprising the sheath 222 and which is adapted to cinch or close the material of sheath 222 around the towel 28.

Sleeve 220 additionally incorporates sleeve arms 226 and 228, collars 236 and 238 and drawstring members 242 and 244 each including a drawstring 248 and retaining clip 250, all similar in structure, configuration and function to the sleeve arms 26 and 28, collars 38 and 40, and drawstring 48 and clip 50 of the drawstring members 42 and 44 of sleeve 20 and thus the description thereof is incorporated herein by reference with respect to the sleeve embodiment 220. Thus, sleeve 220 is adapted to receive the towel 28 in the same manner as described above with respect to sleeve embodiments 20 and 120 and collars 238 and 240 are adapted to be opened and closed in the same manner as collars 38 and 40 to allow access to the ends of the towel 28 for the same purposes as described earlier and incorporated herein by reference.

Sleeve 220, however, offers the additional feature and advantage of including an elongate pad 270 which is secured or attached as by stitching, sewing or the like means to the underside of the sleeve 220 and, more particularly, to the outer surface 223 of the sheath 222 thereof in the region of the neck 224 and, still more particularly, in a relationship generally normal to the elastic neck band 233 and generally co-linearly with the central longitudinal axis of the sheath 222.

In accordance with the present invention, pad 270 is preferably made of a suitable non-slip material and is adapted to allow the sleeve 220 to be hung or flung over the shoulder of a user in a relationship wherein the pad 270 sits over the shoulder of the user and prevents the sleeve 222 from slipping or sliding off of the user's shoulder.

Figure 7:
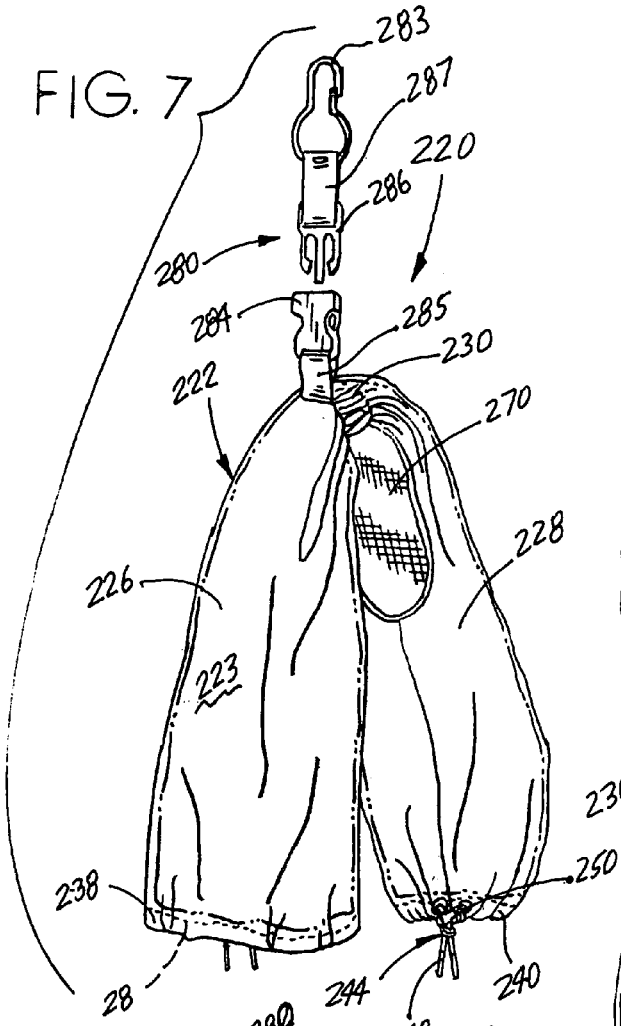
FIG. 7 is a perspective view of yet another embodiment of the towel sleeve of the present invention in its folded and hanging orientation with the buckle member thereof shown in its unbuckled configuration.
Figure 8:
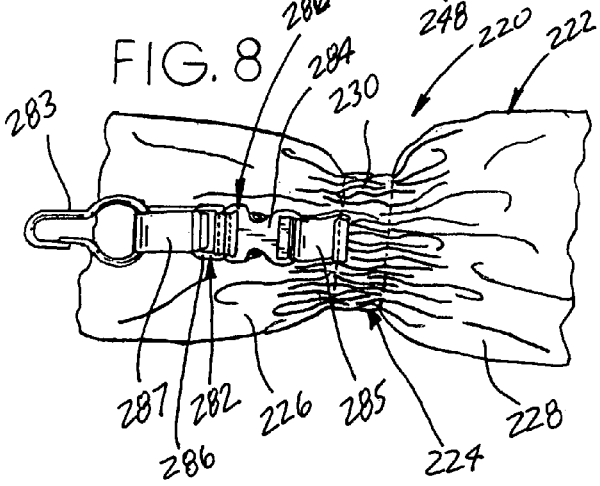
FIG. 8 is a broken top elevational view of the central neck portion of the towel sleeve of FIG. 7.
Figure 9:
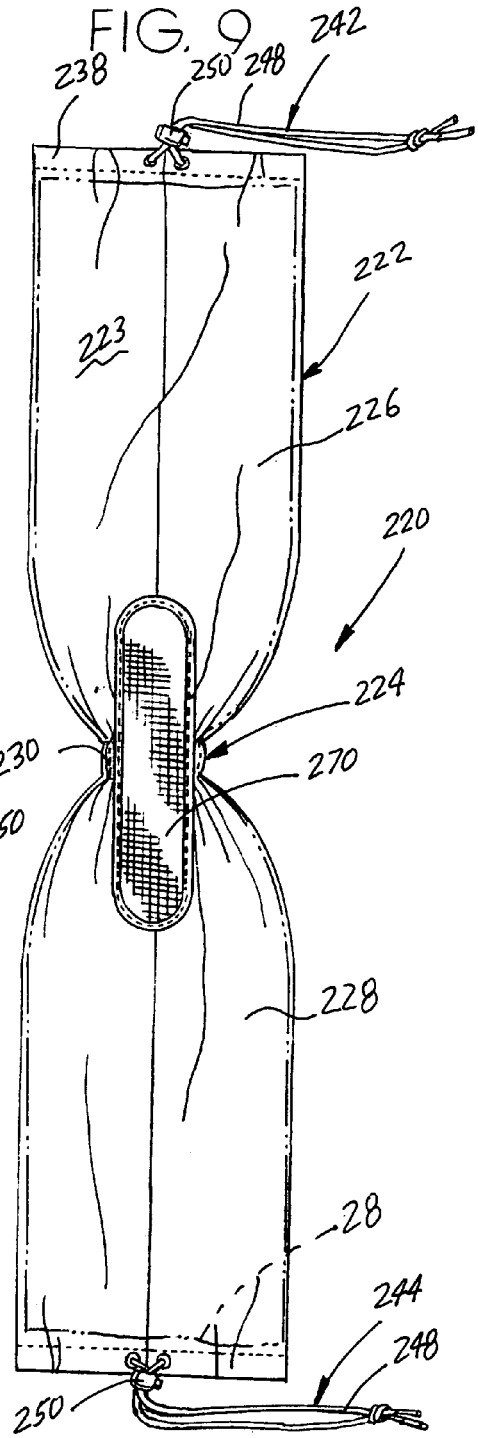
FIG. 9 is a top plan view of the towel sleeve of FIG. 7.

Still further in accordance with the present invention and shown in FIGS. 7 and 8, sleeve 220 additionally incorporates a clip member 280 comprising a buckle 282 and clip in the form of a key ring 283. Buckle 282 is of a construction known in the art and comprises a female buckle member 284 which is secured to a loop member 285 which is stitched or otherwise suitably secured to the outer surface of the sheath 222 in the region of the neck 224. Buckle 282 additionally comprises a male buckle member 286 incorporating flexible fingers adapted to be slid through the opening and into the cavity defined by the female buckle member 284 thereby releasably attaching and connecting the male buckle member 286 to the female buckle member 284 as shown in FIG. 8. Male buckle member 286, in turn, is secured to a loop or the like 287. Key ring 283, in turn, is secured to the male buckle member 286 via the loop 287 and key ring 283 is adapted to allow the sleeve 220 to be secured or clipped to a like key ring 297 secured to the side of a golf bag 295 as shown in FIG. 10. The buckle 282, of course, allows the sleeve 220 to be quickly and efficiently secured or detached from a golf bag or other article as desired by the user.

Figure 11:
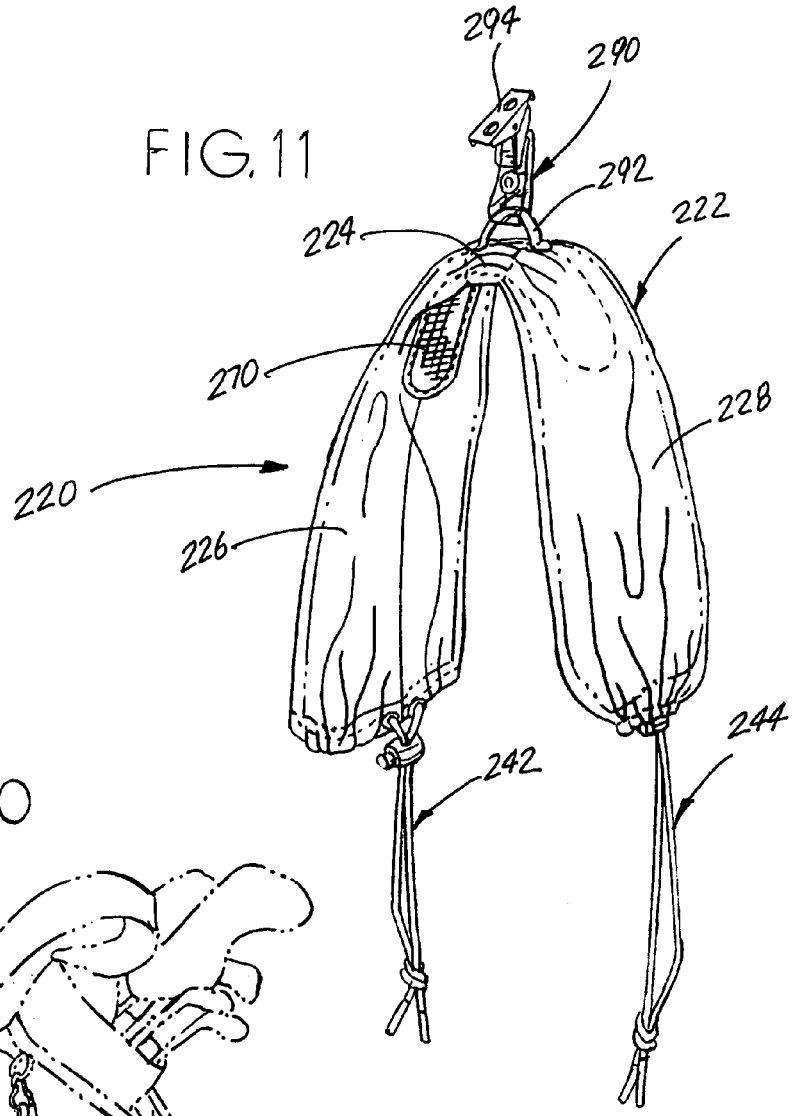
FIG. 11 is a perspective view of yet another embodiment of the towel sleeve of the present invention.

FIG. 11 depicts another clip member embodiment 290 comprising a loop type strap member 292 which is secured or otherwise suitably secured to the outer surface of the sheath 222 of sleeve 220 and an alligator clip 294 of the type known in the art which is secured to and extending outwardly from the end of the loop strap 292. The alligator clip 294, of course, affords the additional advantage of allowing the sleeve 220 to be clipped to a variety of different support articles such as, for example, directly to the outer surface of a golf bag, the handle of a golf bag, or the pocket of the pants or shirt of a user depending, of course, upon the user's needs and preferences.

It will be readily apparent from the foregoing detailed description of the invention and from the illustrations thereof that numerous variations and modifications may be effected without departing from the true spirit and scope of the novel concepts of the present invention.

We claim:

1. A protective sleeve comprising an elongated protective sheath including an outer surface and an inner surface defining a hollow interior adapted to receive an elongate towel therewithin, the protective sheath including opposed ends adapted to be opened to allow access to opposed ends of the towel, the sheath including a generally cylindrically shaped neck having a drawstring member associated therewith and adapted to tighten and hold the towel in the sleeve and hollow sleeve arms which flare outwardly from opposed ends of the neck respectively and a pair of elastic bands unitary with the sheath separate the neck from the respective sleeve arms.

2. The protective sleeve of claim 1 wherein the drawstring member on the neck is located between the pair of elastic bands.

3. The protective sleeve of claim 1 wherein the arms terminate in respective collars incorporating drawstring members adapted to allow the collars to be loosened and tightened.

4. The protective sleeve of claim 1 further comprising an elongate pad which is made of a suitable non-slip material and is secured to the outer surface of the sheath in a relationship overlying the neck.

5. The protective sleeve of claim 1 further comprising a buckle associated with the sheath and adapted to allow the sleeve to be detachably secured to an article such as a golf bag or the like, the buckle being defined by respective male and female buckle members, the female buckle member defining an opening and the male buckle member including at least a pair of flexible fingers adapted to be slid through the opening of the female buckle member for releasably coupling the male buckle member to the female buckle member, one of the male and female buckle members being secured to the outer surface of the sheath and the other of the male and female buckle members being adapted to be secured to an article such as a golf bag or the like.

* * * * *